US007931565B2

(12) United States Patent
Nakano

(10) Patent No.: US 7,931,565 B2
(45) Date of Patent: Apr. 26, 2011

(54) SWING EXERCISE MACHINE

(75) Inventor: Toshio Nakano, Osaka (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 0 days.

(21) Appl. No.: 11/690,218

(22) Filed: Mar. 23, 2007

(65) Prior Publication Data

US 2007/0238579 A1 Oct. 11, 2007

(30) Foreign Application Priority Data

Mar. 28, 2006 (JP) ..... 2006-089641

(51) Int. Cl.
*A63B 22/00* (2006.01)
*A63B 69/00* (2006.01)
*A63G 13/06* (2006.01)

(52) U.S. Cl. ..... 482/51; 472/95; 434/247

(58) Field of Classification Search ..... 482/57, 482/51, 4, 97
See application file for complete search history.

(56) References Cited

U.S. PATENT DOCUMENTS 1,443,355 A * 1/1923 French ..... 180/41
2,048,215 A * 7/1936 Miller ..... 104/63
2,092,448 A * 9/1937 Foote ..... 296/24.37
2,657,621 A * 11/1953 Kantz, Jr. et al. ..... 172/257
3,997,979 A * 12/1976 Turner ..... 472/29
4,222,543 A * 9/1980 Gedig et al. ..... 248/394
4,519,787 A * 5/1985 Williams ..... 446/313
4,957,444 A * 9/1990 Armen ..... 434/247
5,015,035 A * 5/1991 Stoeckl et al. ..... 297/344.17
5,085,425 A * 2/1992 Collins et al. ..... 472/97
5,735,774 A * 4/1998 Maresh ..... 482/57
6,059,666 A * 5/2000 Ohara et al. ..... 472/97
6,120,375 A * 9/2000 Takahashi ..... 463/7
6,199,951 B1 * 3/2001 Zeile et al. ..... 297/341
6,210,167 B1 * 4/2001 Nishiyama ..... 434/247
6,309,015 B1 * 10/2001 Pine ..... 297/85 L
6,315,673 B1 * 11/2001 Kopera et al. ..... 472/60

(Continued)

FOREIGN PATENT DOCUMENTS

JP 8-52183 2/1996

(Continued)

OTHER PUBLICATIONS

An English language Abstract of the corresponding JP 11-4910 A.

(Continued)

*Primary Examiner* — Rinaldi I Rada
*Assistant Examiner* — Robert F Long
(74) *Attorney, Agent, or Firm* — Greenblum & Bernstein, P.L.C.

(57) ABSTRACT

In a swing exercise machine having a seat, a seat driving apparatus that moves the seat along a locus formed by a combination of a periodic swing motion around an antero-posterior swing shaft and a periodic swing motion around a transverse swing shaft, and a control circuit that can control rotation speed and rotation direction of a motor. The control circuit can switch the rotation direction of the motor, so that the seat can be moved in a reverse direction along the locus. Since the human body is asymmetrical in the anteroposterior direction, the regions of the human body where muscle activities occur when the seat is moved in the reverse direction are different from those when the seat is moved in a normal direction. Thereby, it is possible to vary the effect of the swing exercise on the human body.

3 Claims, 15 Drawing Sheets

U.S. PATENT DOCUMENTS

| | | | | |
|---|---|---|---|---|
| 6,402,626 | B1 * | 6/2002 | Beaty | 472/96 |
| 6,616,456 | B1 * | 9/2003 | Nalty et al. | 434/247 |
| 6,808,458 | B1 * | 10/2004 | Jung | 472/97 |
| 6,866,594 | B2 * | 3/2005 | Greenwood | 473/422 |
| 6,921,058 | B2 * | 7/2005 | Becker et al. | 248/419 |
| 6,964,614 | B1 * | 11/2005 | Tsai | 472/58 |
| 7,070,415 | B2 * | 7/2006 | Hojo et al. | 434/247 |
| 7,104,927 | B2 * | 9/2006 | Tsai | 482/51 |
| 7,121,831 | B2 * | 10/2006 | Hojo et al. | 434/247 |
| 7,163,492 | B1 * | 1/2007 | Sotiriades | 482/51 |
| 7,347,806 | B2 * | 3/2008 | Nakano et al. | 482/51 |
| 7,604,293 | B2 * | 10/2009 | Matsuhashi | 297/216.2 |
| 7,608,017 | B2 * | 10/2009 | Nakanishi | 482/51 |
| 7,736,240 | B2 * | 6/2010 | Chuang et al. | 472/97 |
| 7,736,277 | B2 * | 6/2010 | Nakanishi | 482/51 |
| 2002/0115536 | A1 * | 8/2002 | Hojo et al. | 482/51 |
| 2003/0230695 | A1 * | 12/2003 | Becker et al. | 248/419 |
| 2006/0025226 | A1 * | 2/2006 | Nakano et al. | 472/97 |
| 2006/0073939 | A1 * | 4/2006 | Nakanishi | 482/51 |
| 2006/0147887 | A1 * | 7/2006 | Greenwood | 434/247 |
| 2007/0238579 | A1 * | 10/2007 | Nakano | 482/51 |
| 2007/0264903 | A1 * | 11/2007 | Chuang et al. | 446/313 |
| 2007/0275358 | A1 * | 11/2007 | Nakanishi | 434/247 |
| 2007/0284922 | A1 * | 12/2007 | Matsuhashi | 297/216.2 |
| 2007/0293373 | A1 * | 12/2007 | Nakanishi | 482/51 |
| 2008/0009395 | A1 * | 1/2008 | Tseng | 482/51 |
| 2008/0058110 | A1 * | 3/2008 | Chen | 472/97 |
| 2009/0075783 | A1 * | 3/2009 | Nakanishi | 482/51 |
| 2010/0125024 | A1 * | 5/2010 | Nakano et al. | 482/4 |

FOREIGN PATENT DOCUMENTS

| | | |
|---|---|---|
| JP | 2000-279270 | 10/2000 |
| JP | 2001-286578 | 10/2001 |
| JP | 3394889 | 1/2003 |
| JP | 3394890 | 1/2003 |
| JP | 2004-135807 | 5/2004 |
| JP | 2004-344334 | 12/2004 |
| JP | 2005-013463 | 1/2005 |
| JP | 2005-245638 | 9/2005 |

OTHER PUBLICATIONS

An English language Abstract of the corresponding JP 11-4911 A.

English language Abstract of JP 2005-245638.

English language Abstract of JP 2001-286578.

Japanese Office action, dated Oct. 26, 2010, along with a partial English-language translation thereof.

* cited by examiner

SWING EXERCISE MACHINE

BACKGROUND OF THE INVENTION

1. Field of the Invention

The present invention relates to a swing exercise machine which swings a seat to provide an exercise effect to a trainee.

2. Description of the Related Art

For example, Japanese Patents No. 3394889 and 3394890 respectively disclose conventional swing exercise machines such as a balance exercise machine and a lumbago prevention exercise machine, which realize a series of swing patterns of a seat smoothly while a trainee sits on the swinging seat with using a six-axial parallel driving mechanism.

Japanese Laid-Open Patent Publication No. 2005-245638 discloses a conventional electrically moving seat as an exercise machine which moves a disc shaped seat reciprocally in both of an anteroposterior direction and a transverse direction.

Japanese Laid-Open Patent Publication No. 2001-286578 discloses a conventional balance exercise machine which realizes a pitching motion in an anteroposterior direction and a rolling motion in a transverse direction with a single motor and a link mechanism.

In the above-mentioned conventional swing exercise machines, the motion of the seat is monotonous because it is a simple combination of a pitching motion and a rolling motion, so that the body of the trainee adapts to the simple swing motion. In addition, parts of the body which can receive stimulation by the simple motion are limited, so that the exercise becomes modestly beneficial. Furthermore, although the exercise must be continued in a predetermined term to obtain an effect, the trainee will be tired of the exercise of the simple motion, so that the trainee is required patience and persistence to continue the exercise. Consequently, the trainee may stumble along the way of the exercise. Especially, when the exercise is intended to a periodic swing motion, the direction of the periodic swing may become an important parameter to increase the effect of the exercise. However, there is no specific proposal of the direction of the periodic swing motion, conventionally. Furthermore, there is no specific consideration in view of the effect for living body.

SUMMARY OF THE INVENTION

A purpose of the present invention is to provide a swing exercise apparatus which can switch the driving direction of the periodic swing motion of the seat so as to vary the effect of the swing exercise to the human body, and thereby, enabling to expect a large effect of the exercise.

A swing exercise machine in accordance with an aspect of the present invention comprises: a seat on which a trainee sits; a seat driving apparatus that moves the seat periodically in at least one direction among an anteroposterior direction, a transverse direction and a vertical direction, and swings the seat around at least one axis among an anteroposterior axis, a transverse axis and a vertical axis; and a reversing circuit to reverse a moving direction of a periodic swing motion of the seat driven by the seat driving apparatus.

Since the human body is asymmetrical in the anteroposterior direction, a reaction of the human body when it receives an acceleration force forward is different from that when it receives an acceleration force backward. Although the human body is relatively symmetrical in the transverse direction and muscles and anatomy are also formed symmetrical with respect to the spine in the transverse direction, muscles reacting to the acceleration in left hand are different to muscles reacting to the acceleration in right hand.

According to such a configuration, the seat driving apparatus can switch the driving direction of the seat, so that effect of the swing exercise to the human body, for example, the regions of the human body where muscle activities occur when the seat is moved in a reverse direction is different to that when the seat is moved in a normal direction. Therefore, it is possible to vary the effect of the swing exercise to the human body by a simple method to switch the moving direction of the seat, even though the locus of the swing motion of the seat is the same in the normal direction and in the reverse direction.

While the novel features of the present invention are set forth in the appended claims, the present invention will be better understood from the following detailed description taken in conjunction with the drawings.

BRIEF DESCRIPTION OF THE DRAWINGS

The present invention will be described hereinafter with reference to the annexed drawings. It is to be noted that all the drawings are shown for the purpose of illustrating the technical concept of the present invention or embodiments thereof, wherein.

DETAILED DESCRIPTION OF THE EMBODIMENT

First Embodiment

Figure 1:
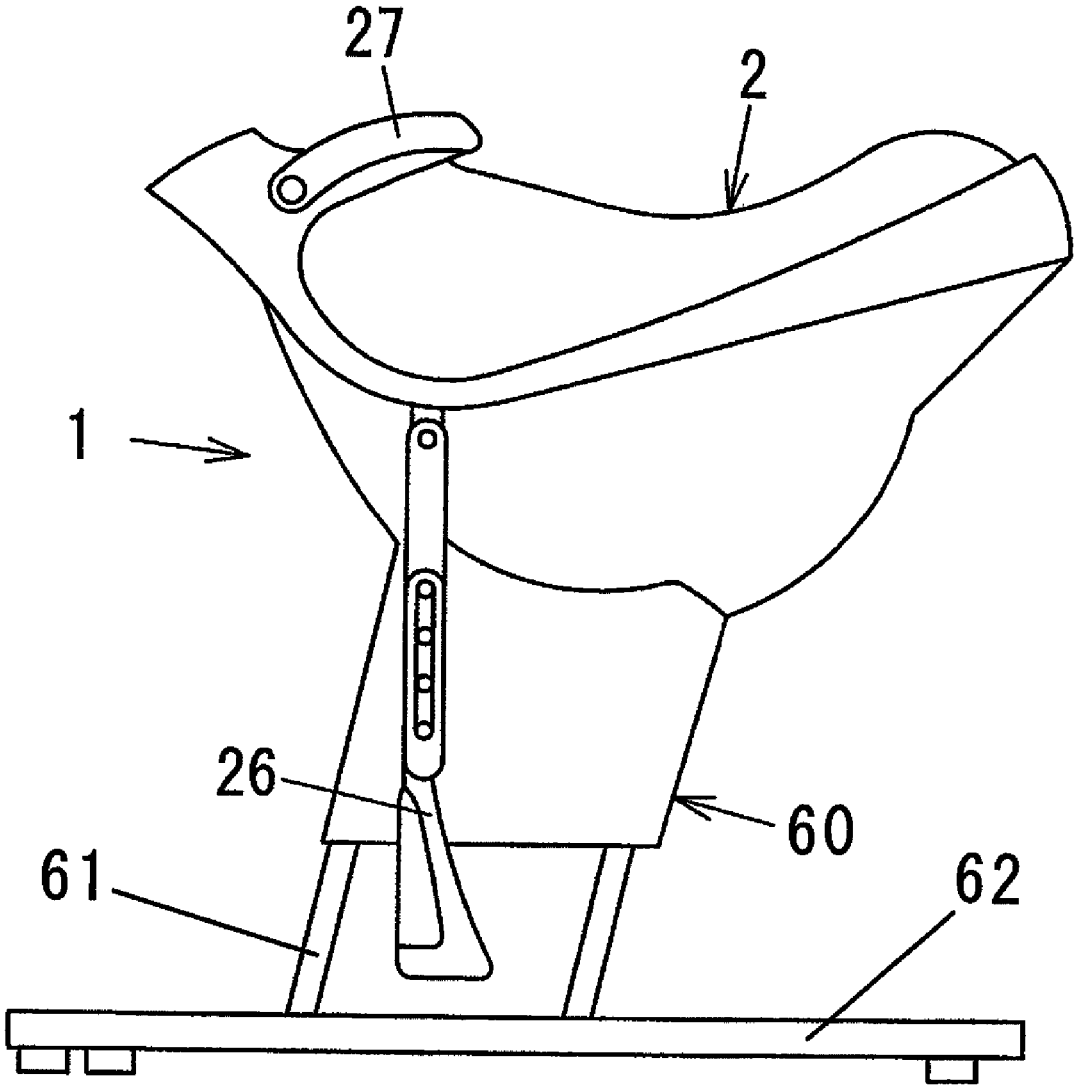
FIG. 1 is a side view showing an appearance of a swing exercise machine in accordance with a first embodiment of the present invention.
Figure 2:
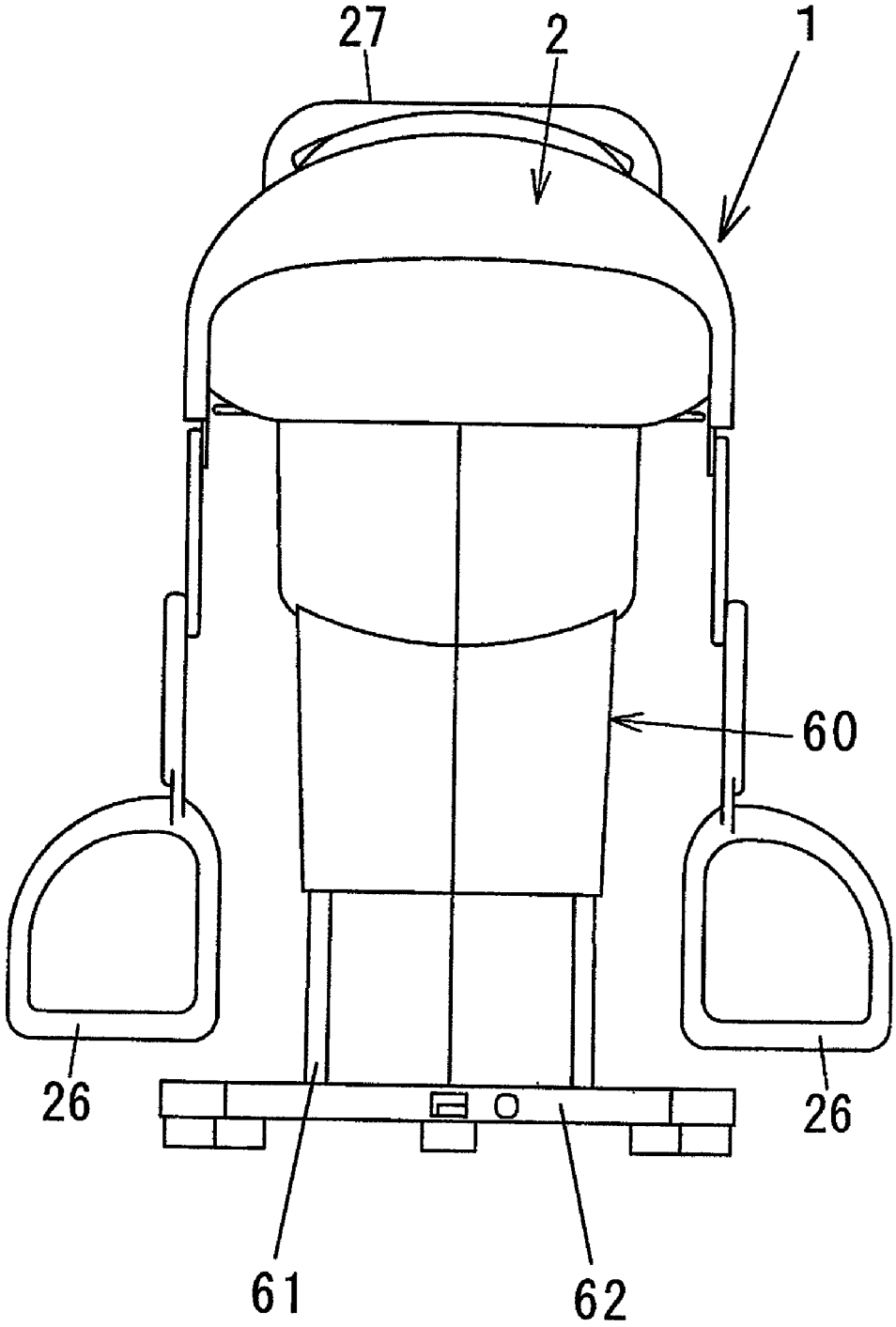
FIG. 2 is a rear view of the swing exercise machine shown in FIG. 1.
Figure 3:
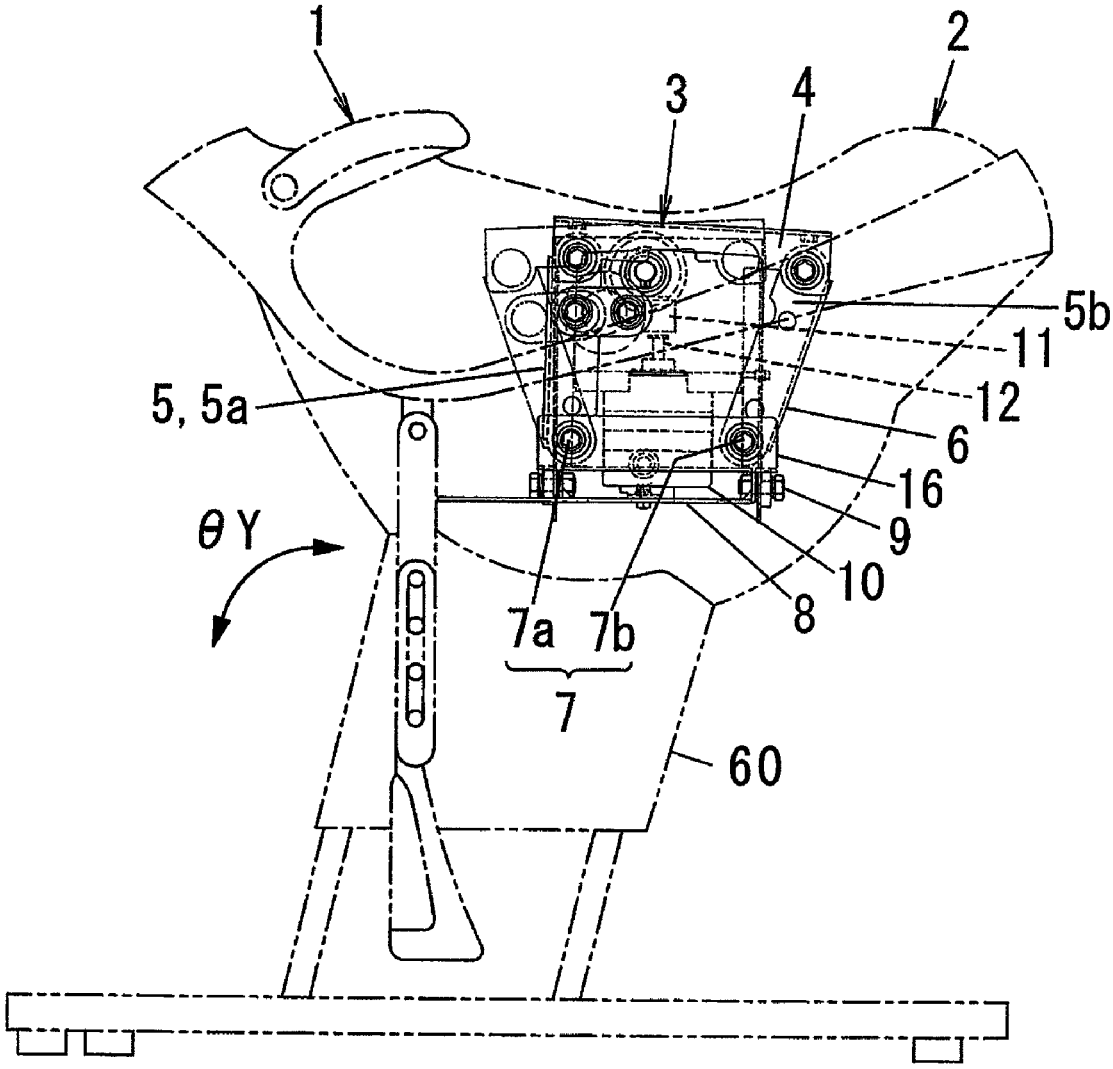
FIG. 3 is a side view showing an entire configuration of the swing exercise machine in the first embodiment.
Figure 4:
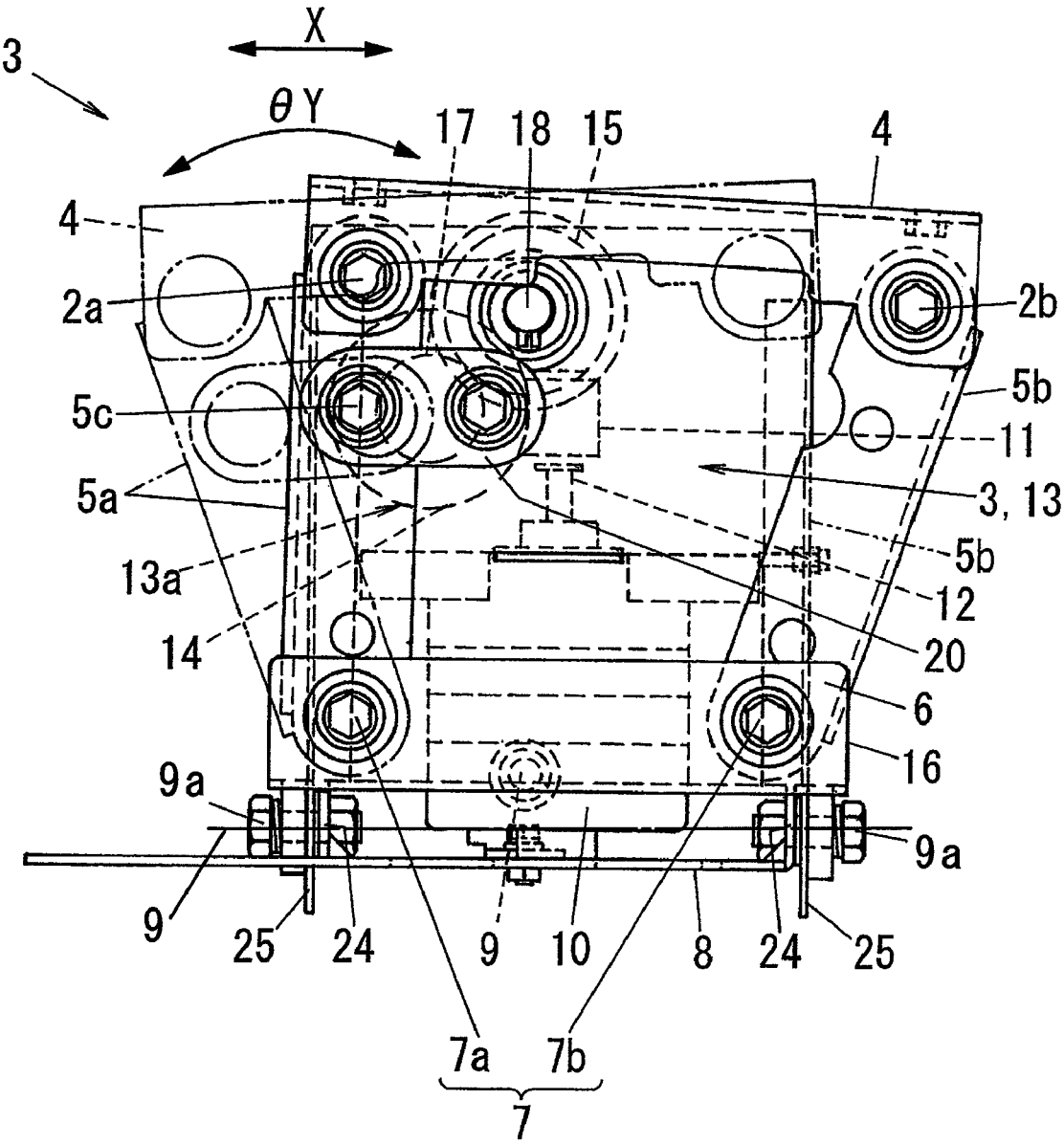
FIG. 4 is a side view showing a configuration of a seat driving apparatus of the swing exercise machine in the first embodiment.
Figure 5:
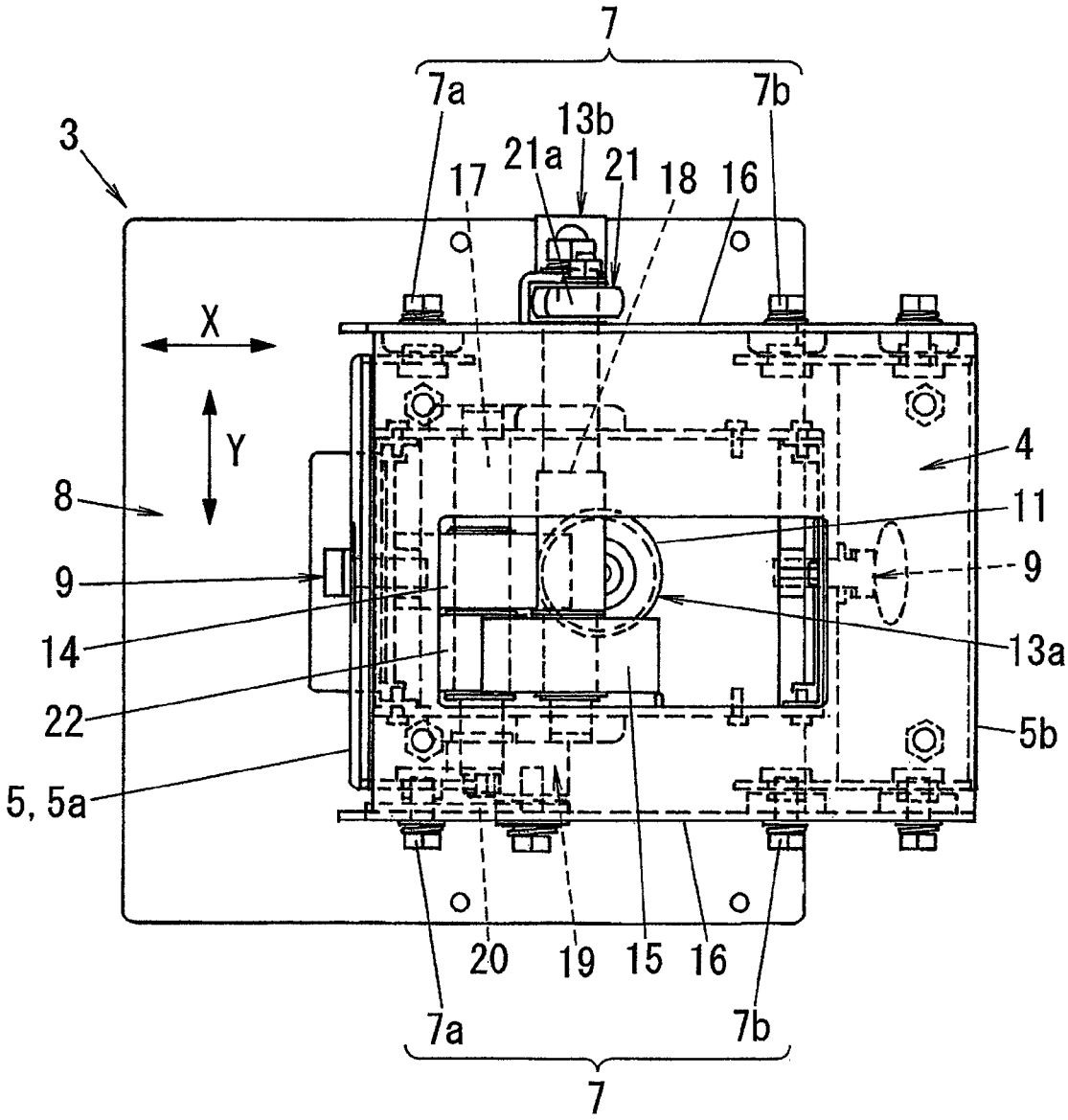
FIG. 5 is a plan view of the seat driving apparatus.
Figure 6:
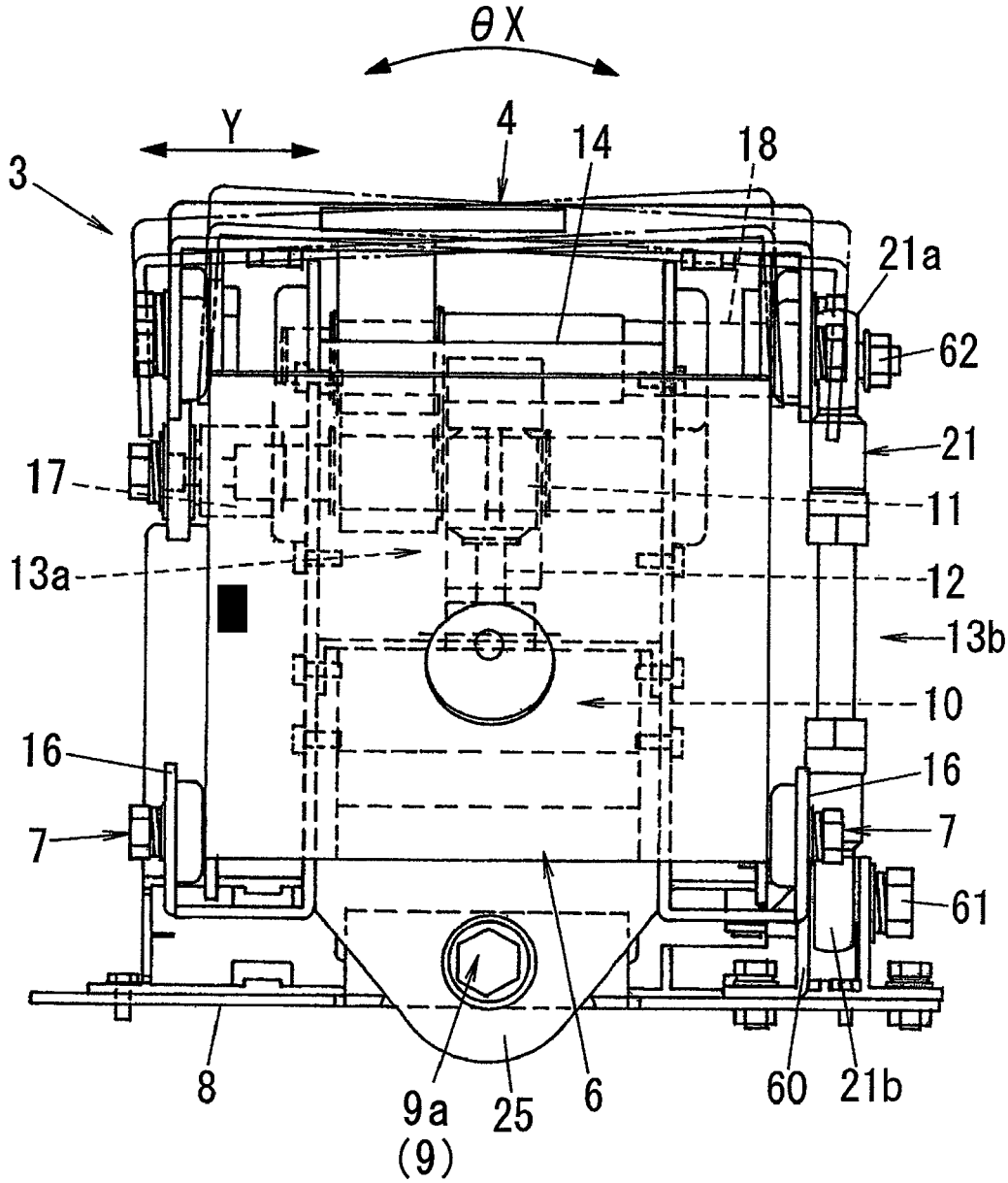
FIG. 6 is a front view of the seat driving apparatus.

A swing exercise machine in accordance with a first embodiment of the present invention is described with reference to the figures. FIG. 1 is a side view and FIG. 2 is a rear view respectively showing an appearance of the swing exercise apparatus 1. FIG. 3 is a side view showing a configuration of the swing exercise machine 1. FIG. 4 is a side view showing a detailed configuration of a seat driving apparatus 3 of the swing exercise machine 1. FIGS. 5 and 6 are respectively plain view and rear view of the seat driving apparatus 3.

The swing exercise machine 1 is comprised of a seat 2 which is similar to a saddle shape or a horseback shape, the seat driving apparatus 3 which is provided in an inside of the seat 2 and periodically swings the seat 2 in at least one direction among X, Y, Z, θX, θY and θZ directions (see FIG. 7B), and a stem 60 which supports the seat 2 and the seat driving apparatus 3. The stem 60 has legs 61 which can be elongated and contracted with respect to a base plate 62. Furthermore, a pair of stirrups 26 is respectively suspended from both sides of the seat 2. A grasp handle 27 is provided in front of the seat 2.

A mechanism of the seat driving apparatus 3 is described. In FIGS. 3, 4 and 6, the seat driving apparatus 3 in a state to swing the seat 2 is illustrated by two dotted chain lines. A pedestal 4, to which the seat 2 is mounted, is supported on a movable table 6 via two pairs of links 5 (a pair of front links 5*a* and a pair of rear links 5*b*) in a manner to be swung, and the movable table 6 is supported on a base plate 8 so as to be swung in a transverse direction. An actuator 13 is provided between the pedestal 4 and the movable table 6. An upper end of each front link 5*a* is pivoted on a front end of the pedestal 4 with an upper front pin 2*a*, and a lower end of each front link 5*a* is pivoted on a front end of the movable table 6 with a lower front pin 7*a*. Similarly, an upper end of each rear link 5*b* is pivoted on a rear end of the pedestal 4 with an upper rear pin 2*b*, and a lower end of each rear link 5*a* is pivoted on a rear end of the movable table 6 with a lower rear pin 7*b*. A pair of the lower front pins 7*a* and a pair of the lower rear pins 7*b* provided at both sides of the movable table 6 respectively constitute front and rear transverse swing shafts 7 which enables the links 5 to rotate around axes in the transverse direction shown by arrow "Y", as shown in FIG. 6. Thereby, the pedestal 4 can be swung reciprocally in an anteroposterior direction shown by arrow "θY", as shown in FIG. 4.

As shown in FIGS. 4 and 6, a pair of pivoting plates 24 is formed vertically upward at both ends of the base plate 8 in the anteroposterior direction shown by arrow "X". On the other hand, a pair of coupling plates 25 is formed vertically downward at both end of the movable table 6 in the anteroposterior direction shown by arrow "X", so that the coupling plates 25 are respectively coupled with the pivoting plates 24 via pins 9*a* which constitute an anteroposterior swing shaft 9. The pins 9*a* are respectively disposed at centers of the base plate 8 in the transverse direction so as to pivot the movable table 6 around thereof. Consequently, the pedestal 4 can be swung reciprocally around the anteroposterior swing shaft 9 in a direction shown by arrow "θX".

On the other hand, the actuator 13 is comprised of a single motor 10, a first driving unit 13*a* and a second driving unit 13*b*. The first driving unit 13*a* converts a driving force of an output shaft 12 of the motor 10 to reciprocal linear motion of the pedestal 4 in the anteroposterior direction shown by arrow "X" or reciprocal swing motion around the transverse swing shafts 7 shown by arrow "θY". The second driving unit 13*b* converts the driving force of the output shaft 12 of the motor 10 to reciprocal swing motion of the pedestal 4 around the anteroposterior swing shaft 9 shown by arrow "θX". The motor 10 is provided on the movable table 6 in a manner so that the output shaft 12 becomes perpendicular to a bottom face of the movable table 6.

As shown in FIGS. 4 and 5, the first driving unit 13*a* is comprised of a motor gear 11 which is fixed to the output shaft 12 of the motor 12, a first gear 14 which is engaged with the motor gear 11, a first shaft 17 to which the first gear 14 is fixed so that the driving force of the output shaft 12 is transmitted to the first shaft 17, an eccentric crank 19 which is coupled to an end of the first shaft 17, and an arm link 20, an end of which is coupled to the eccentric crank 19 and the other end of which is pivoted on the front link 5*a* with a pin 5*c*. Both ends of the first shaft 17 are respectively borne on the movable table 6. When the first shaft 17 is rotated, the eccentric crank 19 circulates eccentrically with respect to the first shaft 17, so that the front link 5*a* moves reciprocally via the arm link 20 in the anteroposterior direction shown by arrow "X". Thereby, the pedestal 4 linked to the links 5, in other words, the seat 2 is swung in the direction shown by arrow "74 Y" in FIGS. 3 and 4.

As shown in FIGS. 5 and 6, the second driving unit 13*b* is comprised of a gear 22 which is fixed on the first shaft 17, a second gear 15 which is engaged with the gear 22, a second shaft 18 to which the second gear 15 is fixed, and an eccentric rod 21, an end of which is coupled eccentrically to the second shaft 18 and the other end of which is rotatably pivoted on the base plate 8. Both ends of the second shaft 18 are respectively borne on the movable table 6. The eccentric rod 21 is disposed on one of the sides (right side or left side) of the pedestal 4 (which is illustrated in right side in FIGS. 5 and 6). An upper end 21*a* of the eccentric rod 21 is coupled eccentrically to an end of the second shaft 18 with a pin 62, as shown in FIG. 6.

A lower end 21*b* of the eccentric rod 21 is rotatably pivoted on a coupling member 27, which has an L-shape and fixed on the base plate 8, with a pin 61. Therefore, when the second shaft 18 is rotated, the upper end of the eccentric rod 21 circulates eccentrically, so that the pedestal 4 or the seat 2 is reciprocally rotated around the anteroposterior swing shaft 9 in a direction shown by arrow "θX", as shown in FIG. 6.

When the output shaft 12 of the motor 10 rotates, the first shaft 17 is rotated via the engagement of the motor gear 11 and the first gear 14, and also, the second shaft 18 is rotated via the engagement of the gear 22 and the second gear 15, simultaneously. When the first shaft 17 rotates, the eccentric crank 19 which is coupled to an end of the first shaft 17 circulates eccentrically, so that the front links 5*a* are rotated around the transverse swing shaft 7 disposed at front side in the anteroposterior direction shown by arrow X". Simultaneously, the rear links 5*b* are rotated around the transverse swing shaft 7 disposed at rear side. Consequently, the pedestal 4 or the seat 2 is reciprocally moved and swung in the anteroposterior direction shown by arrow X".

Figure 7A:
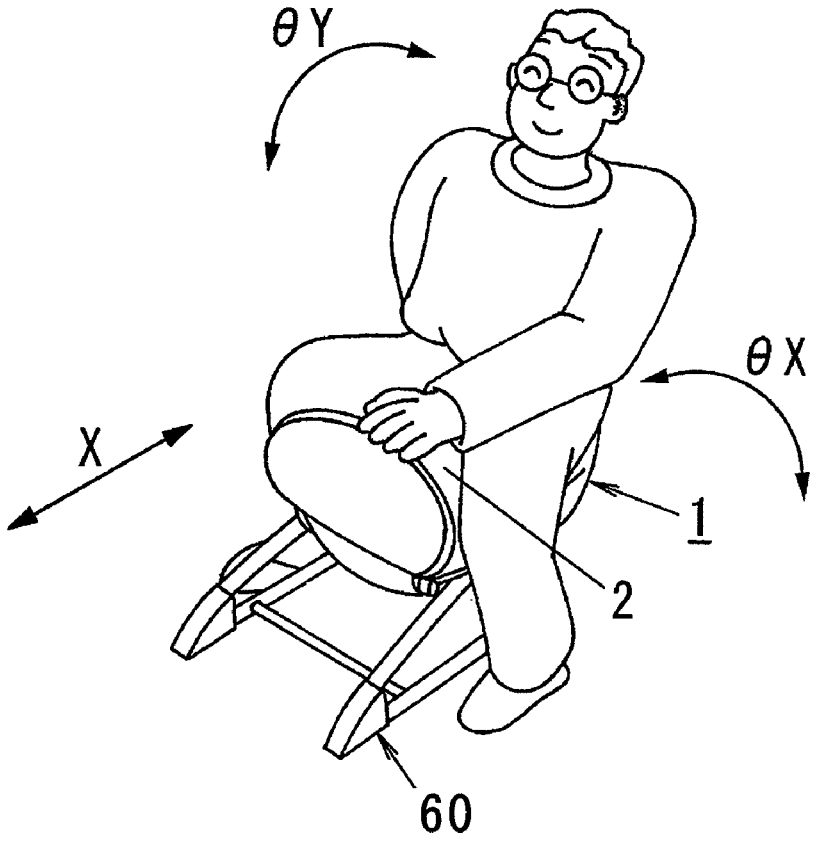
FIG. 7A is a perspective view showing a condition that the swing exercise machine is used by a trainee.
Figure 7B:
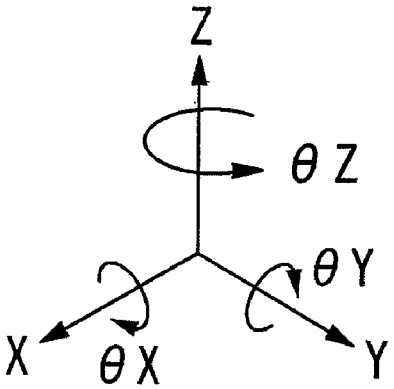
FIG. 7B is an explanation view showing directions of linear motions and swing motions of the seat in the swing exercise machine.

On the other hand, when the second shaft 18 rotates, the upper end of the eccentric rod 21 circulates eccentrically, so that the pedestal 4 or the seat 2 is reciprocally rotated around the anteroposterior swing shaft 9. Therefore, when a trainee sits on the seat 2 and the motor 10 is driven, the seat 2 is moved in the anteroposterior direction shown by arrow "X", in the transverse direction shown by arrow "Y", and swung in the directions shown by arrows "θX" and "θY", as shown in FIGS. 7A and 7B. Thereby, the trainee can exercise faculties of balance or motility of the body.

Since a plurality of motions in different directions can be performed by the single motor 10, mechanism and control of the swing exercise machine 1 can be simplified, and thereby, enabling cost reduction and downsizing of the swing exercise machine 1. In addition, since the output shaft 12 of the motor 10 is required to be protrude only one direction, the orientation of the output shaft 12 of the motor 10 has a lot of flexibility in comparison with a case where the output shaft of the motor is require to protrude in opposite directions. Consequently, the seat driving apparatus 3 can be contained in the seat 2 so as to reproduce the simulated horseback riding motion, faithfully.

Figure 7C:
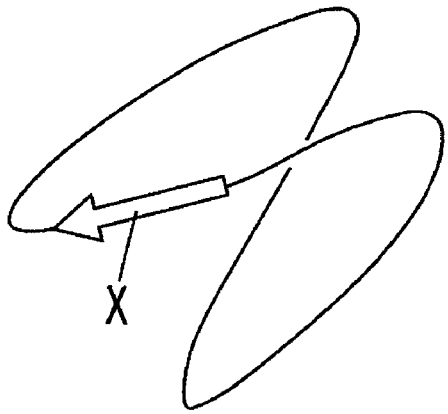
FIG. 7C is an explanation view showing a locus of a periodic swing motion of the seat.

FIG. 7C shows a locus of a periodic swing motion of the center of the seat 2. In the swing exercise machine 1 for intending such a periodic swing motion, directions of the periodic swing motion may become important parameters for increasing effect of the exercise. Then, the swing exercise machine 1 can switch the moving direction of the periodic swing motion with using a reversing function of the swing motion.

Figure 8:
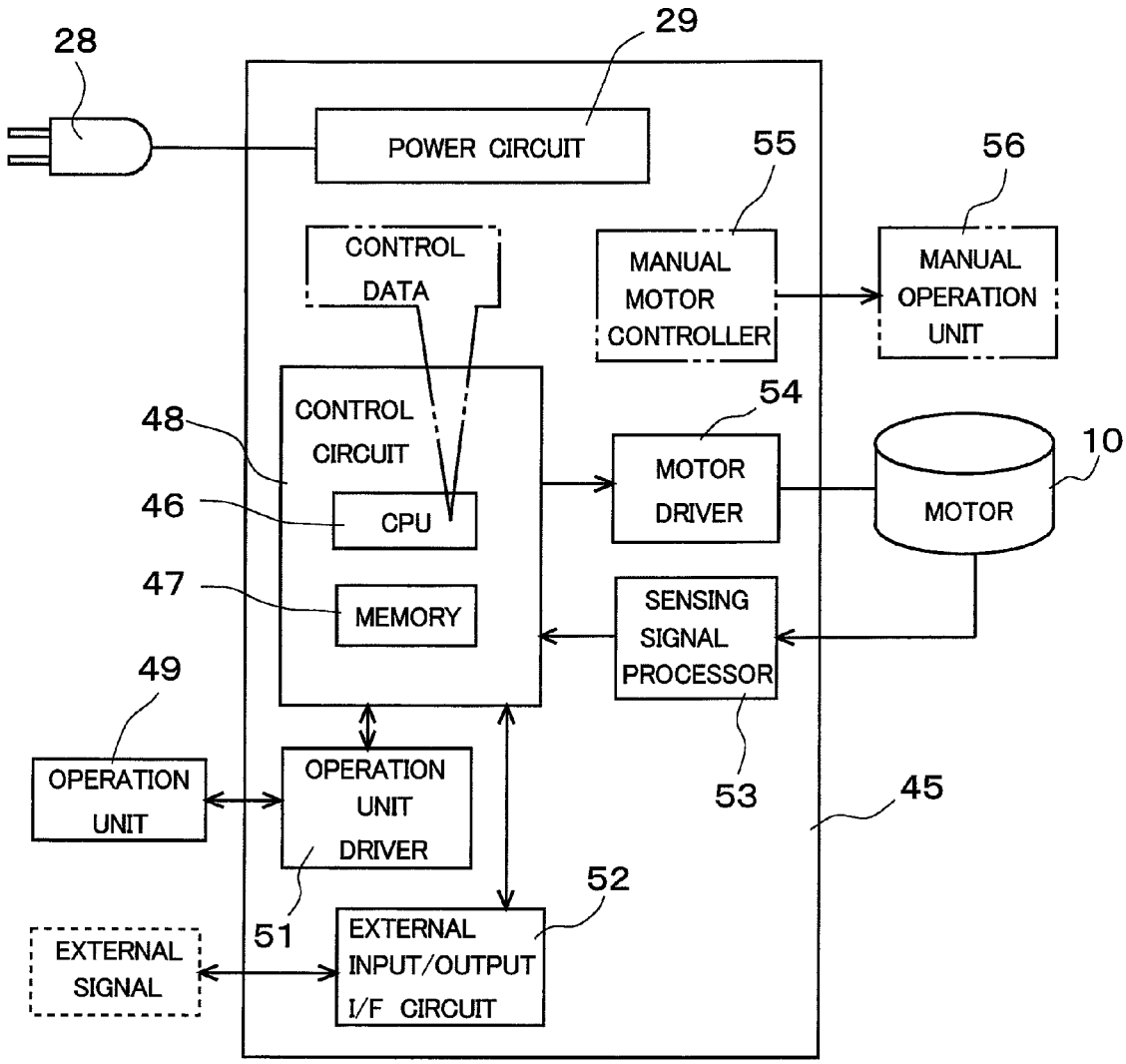
FIG. 8 is a block diagram showing an electric configuration for driving the seat driving apparatus.

FIG. 8 shows an electric block diagram that drives the seat driving apparatus 3. A commercial AC power inputted through a plug 28 is converted to DC voltages of 15V, 140V, and so on through a power circuit 29, and supplied to each circuit of a circuit board 45. A control circuit 48, which is comprised of a microprocessor (CPU) 46 for controlling the driving operation and a memory 47 which memorizes control data such as patterns of periodic swing motions, is provided on the circuit board 45. The control circuit 48 receives an input signal from an operation unit 49 through an operation unit driver 51 or an external signal inputted from an external apparatus through an external input and output I/F circuit 52. In the latter case, the reversing function of the swinging motion can be controlled by the external signal, so that the timing for reversing the swing motion can be synchronized with sounds or pictures, and thereby, the ambience of the exercise can be increased.

A sensing signal processor 53 and a motor driver 54 are provided between the motor 10 and the control circuit 48. The control circuit 48 controls rotation speed, rotation direction, and so on of the motor 10 through the motor driver 54. A rotation sensor such as a rotary encoder (not shown in the figure) is provided on the motor 10, and the sensing signal processor 53 processes signals outputted from the rotation sensor and inputs the processed signal to the control circuit 48. Thereby, the control circuit 48 can perform feedback control of the motor 10. The control circuit 48 decides variation of the rotation speed and timing for switching the rotation direction of the motor 10 corresponding to data stored in the memory 47. In the latter case, the control circuit 48 serves as a timing setter.

Hereupon, methods to vary the rotation speed of the motor 10 and to switch the rotation direction of the motor 10 are described. For example, predetermined control data corresponding to the variation of the rotation speed of the motor 10 and the timing for switching the rotation direction of the motor 10 are previously stored in the memory 47, and the microprocessor 46 performs a predetermined control program for controlling the motor 10 based on the predetermined control data. Alternatively, a manual motor controller 55 and a manual operation unit 56 may be provided further to the control circuit 48. The manual operation unit 56 is operated by the trainee to set a rotation speed of the motor 10 and/or to set a timing to switch the rotation direction of the motor 10. The manual operation unit 56 outputs signals corresponding to the operation by the trainee, and the manual motor controller 55 controls the motor driver 54 corresponding to the signals outputted from the manual operation unit 56. Thereby, the rotation speed and the rotation direction of the motor 10 can be changed forcibly by the intention of the trainee with no relation to the control program of the motor 10.

The seat driving apparatus 3 illustrated in the FIGS. 3 to 6 can be switched the rotation direction of two swing shafts, that is the front and rear transverse swing shafts 7 and the anteroposterior swing shaft 9 by switching the rotation direction of the motor 10 with keeping a predetermined phase relation. Thereby, a complex reversible swing motion can easily be realized with using the single motor 10, and the seat driving apparatus 3 needs only one motor, so that the control of the motor can be simplified. Furthermore, swing exercises respectively having different effect to the human body can be realized only by switching the rotation direction of the motor 10.

Second Embodiment

A swing exercise machine in accordance with a second embodiment of the present invention is described. In the above mentioned first embodiment, the seat driving apparatus 3 of the swing exercise machine 1 needs only one motor 10. A seat driving apparatus 3' of the swing exercise machine 1 of the second embodiment uses a plurality of, for example, two motors 10*a* and 10*b* which individually drives a pedestal 4 around an anteroposterior swing shaft 58 and a transverse swing shaft 59 as shown in FIGS. 9A and 9B.

Figure 9A:
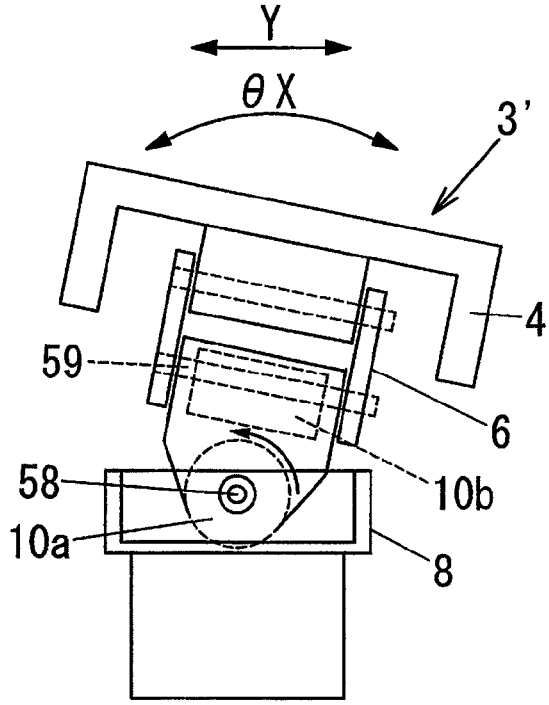
FIG. 9A is a front view showing a configuration of a seat driving apparatus of a swing exercise machine in accordance with a second embodiment.
Figure 9B:
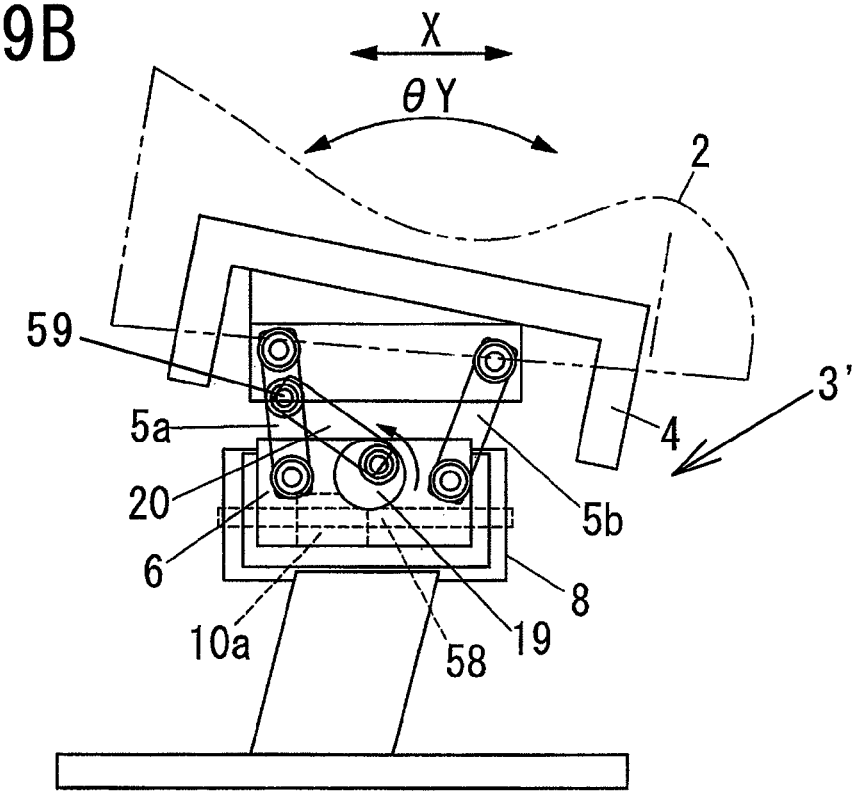
FIG. 9B is a side view of the seat driving apparatus shown in FIG. 9A.

In the seat driving apparatus 3', a movable table 6 and a base plate 8 are rotatably coupled with each other via the anteroposterior swing shaft 58 so as to enable to swing around the anteroposterior swing shaft 58, and thereby, enabling to swing a pedestal 4 or a seat 2 in a direction shown by arrow "θX" with a driving force of the motor 10*a*, as shown in FIG. 9A. Both ends of the transverse swing shaft 59 are pivoted on a pair of front links 5*a*. An end of an arm link 20 is rotatably engaged with an end of the transverse swing shaft 59, and the other end of the arm link 20 is rotatably pivoted on an eccentric crank 19 which is fixed on an output shaft of the motor 10*b*. Thereby, the pedestal 4 or the seat 2 is swung in a direction shown by arrow "θY" with a driving force of the motor 10*b*, as shown in FIG. 9B.

In the second embodiment, since the anteroposterior swing shaft 58 and the transverse swing shaft 59 are individually driven by two motors 10*a* and 10*b*, it is possible to reverse a periodic swing motion with changing phase relation between the anteroposterior swing shaft 58 and the transverse swing shaft 59. In other words, an effect of the swing exercise to the human body in a normal mode where the seat driving apparatus 3' is driven in a normal mode can be varied largely from that in a reverse mode where the seat driving apparatus 3' is driven in a reverse mode by reversing the rotation directions of the motors 10*a* and 10*b* with no cooperation. Especially, regions of the human body where muscle activities occur can be varied, so that it is possible to increase the regions mobilized with complicating the balances. Consequently, it is possible to delay the trainee to adapt to the swing exercise, and to maintain the effect of the swing exercise or the motivation of the trainee to continue the practice of the swing exercise.

Figure 10A:
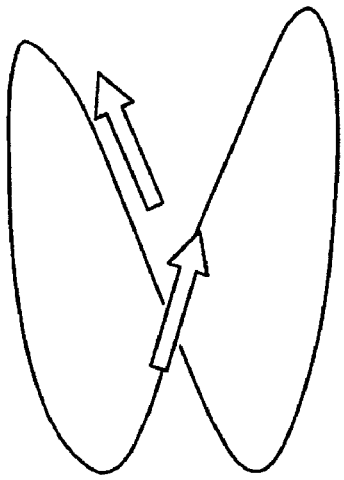
FIG. 10A is a top view schematically showing a locus of a center of the seat when the seat driving apparatus is driven in a normal mode in the second embodiment.
Figure 10C:
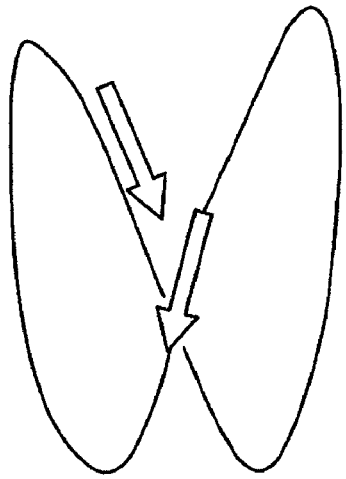
FIG. 10C is a top view schematically showing a locus of a center of the seat when the seat driving apparatus is driven in a reverse mode.
Figure 10B:
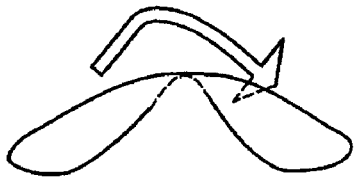
FIG. 10B is a rear view schematically showing the locus of the center of the seat when the seat driving apparatus is driven in the normal mode in the second embodiment.
Figure 10D:
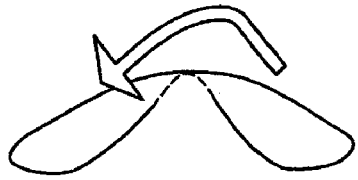
FIG. 10D is a rear view schematically showing the locus of the center of the seat when the seat driving apparatus is driven in the reverse mode.

Subsequently, the motion of the swing exercise machine 1 is described. FIGS. 10A and 10B schematically show a locus of a center of the pedestal 4 or the seat 2 (hereinafter, referred to only the seat 2) when the seat driving apparatus 3' is driven in the normal mode, and FIGS. 10C and 10D schematically show the locus of the center of the seat 2 when the seat driving apparatus 3' is driven in the reverse mode, where the phase relation between the anteroposterior swing shaft 58 and the transverse swing shaft 59 is maintained constant. In comparison with these views, even when the driving direction of the seat driving apparatus 3' is driven in the reverse mode, shape of the locus in the reverse mode becomes the same as that in the normal mode. However, in consideration of the orientation of the locus, the motion of the seat 2 in the reverse mode is clearly different from that in the normal mode. Specifically, in case that the seat driving apparatus 3' is driven in the normal mode shown in FIGS. 10A and 10B, the seat 2 moves forward with acceleration or deceleration when the seat 2 passes a center apex of the locus. On the contrary, in case that the seat driving apparatus 3' is driven in the reverse mode shown in FIGS. 10C and 10D, the seat 2 moves backward with acceleration or deceleration when the seat 2 passes a center apex of the locus.

By the way, since the human body is asymmetrical in the anteroposterior direction, a reaction of the human body when it receives an acceleration force forward is different from that when it receives an acceleration force backward. Although the human body is relatively symmetrical in the transverse direction and muscles and anatomy are also formed symmetrical with respect to the spine in the transverse direction, muscles reacting to the acceleration in left hand are different to muscles reacting to the acceleration in right hand. Therefore, a reciprocating motion in the anteroposterior direction is effective to innervate the muscles which are asymmetrical in the anteroposterior direction of the human body, repeatedly. Furthermore, the reciprocating motion in the transverse direction is effective to innervate the muscles symmetrical in the transverse direction, alternately and repeatedly.

When an angular velocity of a periodic swing motion by the seat driving apparatus 3' is constant, the effect of the periodic swing motion to the human body is not varied by the switching of the driving direction of the seat driving apparatus 3', theoretically. However, when the angular velocity of the periodic swing motion by the seat driving apparatus 3' is not constant, the effect of the periodic swing motion to the human body is varied by the switching of the driving direction of the seat driving apparatus 3'. For example, when the periodic swing motion by the seat driving apparatus 3' is in the forward phase, in other words, the seat 2 is moved forward and the angular velocity is fast, muscles of abdomen are effectively worked out. Alternatively, when the periodic swing motion by the seat driving apparatus 3' is in the backward phase, in other words, the seat 2 is moved backward and the angular velocity is fast, muscles of back are effectively worked out.

In the second embodiment, since the motors 10*a* and 10*b* are individually driven, it is possible to control the motors 10*a* and 10*b* in a manner so that the periodic swing motion in the transverse direction is asynchronous with the periodic swing motion in the anteroposterior direction. Thereby, the shape of the locus of the periodic swing motion when the seat driving apparatus 3' is driven in the reverse mode can be different from that when the seat driving apparatus 3' is driven in the normal mode. Therefore, the effects of the periodic swing motion to the human body can be varied even though the angular velocity of the periodic swing motion is constant with driving the motors 10*a* and 10*b* in constant rotation speeds. In addition, the rotation speed of the motor 10*b* can be different from that of the motor 10*a*. In such a case, the variation of the moving speed or acceleration of the seat 2 at the turning point in the direction of the swing motion can be varied, so that it is possible to increase the regions mobilized with complicating the balances. Consequently, it is possible to delay the trainee to adapt to the exercise, and to maintain the effect of the swing exercise or the motivation to continue the practice of the swing exercise.

FIGS. 11A to 11D and 12A to 12D show phenomena where the effects of the swing exercises to the human body are different.

Figure 11B:
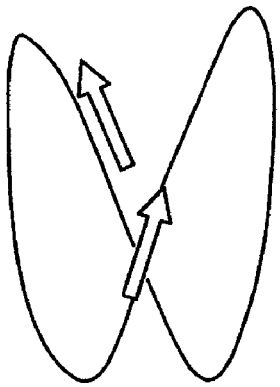
FIG. 11B is a top view schematically showing a locus of the center of the seat in a case shown in FIG. 11A.
Figure 11A:
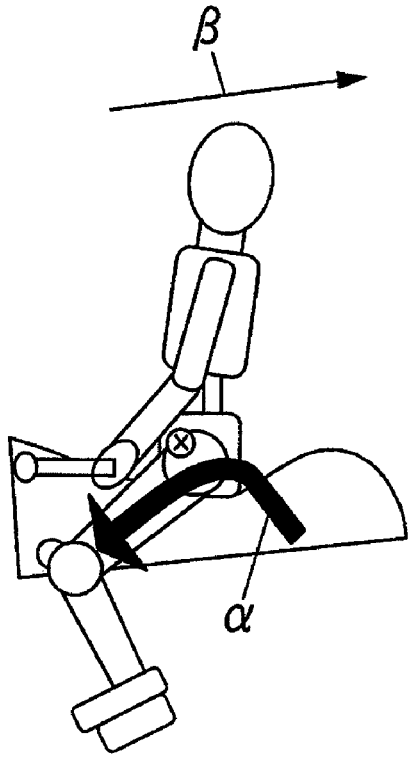
FIG. 11A is a side view schematically showing a phase of the seat to move forward when the seat driving apparatus is driven in the normal mode.

FIG. 11A shows a posture of the trainee, when the seat driving apparatus 3' is driven in the normal mode and the seat 2 moves forward, and FIG. 11B shows a locus of the seat 2. In FIG. 11A, arrow "α" shows a direction of a motion of the seat 2, and arrow "β" shows a direction of reaction of the human body. In this case, the human body receives an acceleration force forward in the standing posture, so that the trunk joints are stretched around the lumber vertebra, and thereby, muscle activities occur in the muscles of abdomen, the adductor muscles, and so on.

Figure 11D:
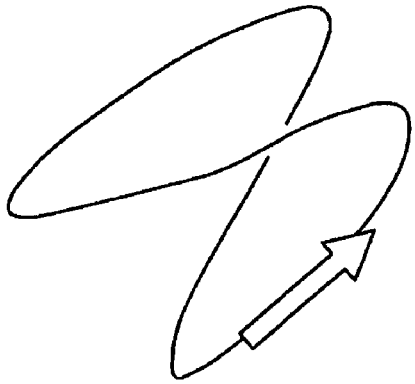
FIG. 11D is a perspective view schematically showing a locus of the center of the seat in a case shown in FIG. 11C.
Figure 11C:
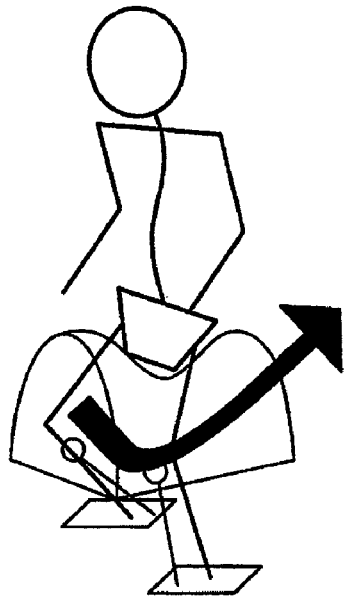
FIG. 11C is a perspective view schematically showing a phase of the seat to move backward when the seat driving apparatus is driven in the normal mode.

FIG. 11C shows a posture of the trainee, when the seat driving apparatus 3' is driven in the normal mode and the seat 2 moves backward, and FIG. 11D shows a locus of the seat 2. In this case, the seat 2 moves backward while it further slants laterally in the direction "θY", so that the human body receives an acceleration force in a direction of composition of the backward and lateral directions. For balancing the human body, the muscles of back and the hamstring (which is a group of muscles necessary for stretching the hip joint or for bending the knee) at a side in the transverse direction are effectively worked out.

Figure 12B:
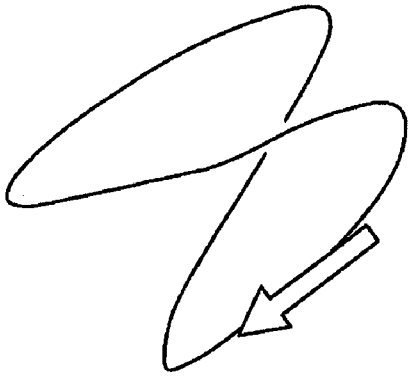
FIG. 12B is a perspective view schematically showing a locus of the center of the seat in a case shown in FIG. 12A.
Figure 12A:
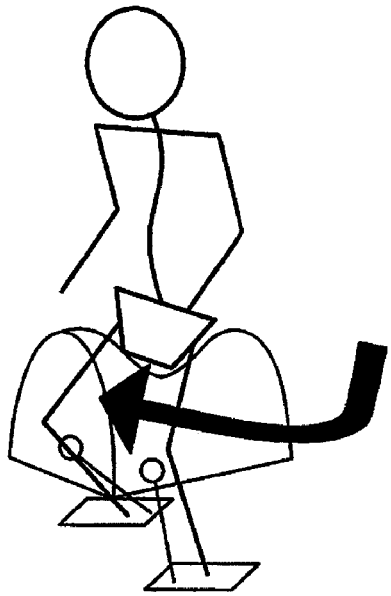
FIG. 12A is a perspective view schematically showing a phase of the seat to move forward when the seat driving apparatus is driven in the reverse mode.

FIG. 12A shows a posture of the trainee, when the seat driving apparatus 3' is driven in the reverse mode and the seat 2 moves forward, and FIG. 12B shows a locus of the seat 2. In this case, the seat 2 moves forward while it further slants laterally in the direction "θY", so that the human body receives an acceleration force in a direction of composition of the forward and lateral directions. For balancing the human body, the muscles of back, the muscles of thigh and the gluteus medius muscles at a side in the transverse direction are effectively worked out. In addition, revolution or side flexion motion occurs in the trunk, so that the muscle activity in the side is innervated.

Figure 12D:
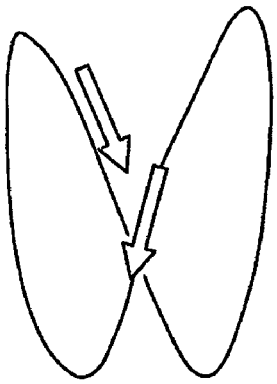
FIG. 12D is a top view schematically showing a locus of the center of the seat in a case shown in FIG. 12C.
Figure 12C:
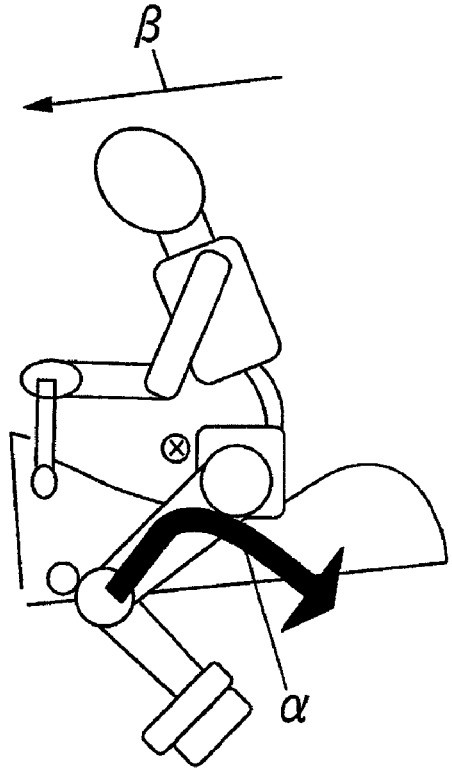
FIG. 12C is a side view schematically showing a phase of the seat to move backward when the seat driving apparatus is driven in the reverse mode.

FIG. 12C shows a posture of the trainee, when the seat driving apparatus 3' is driven in the reverse mode and the seat 2 moves backward, and FIG. 12D shows a locus of the seat 2. In this case, the human body receives an acceleration force backward in the standing posture, so that the trunk joints are bent around the lumber vertebra, and thereby, muscle activities occur in the muscles of back.

Figure 13:
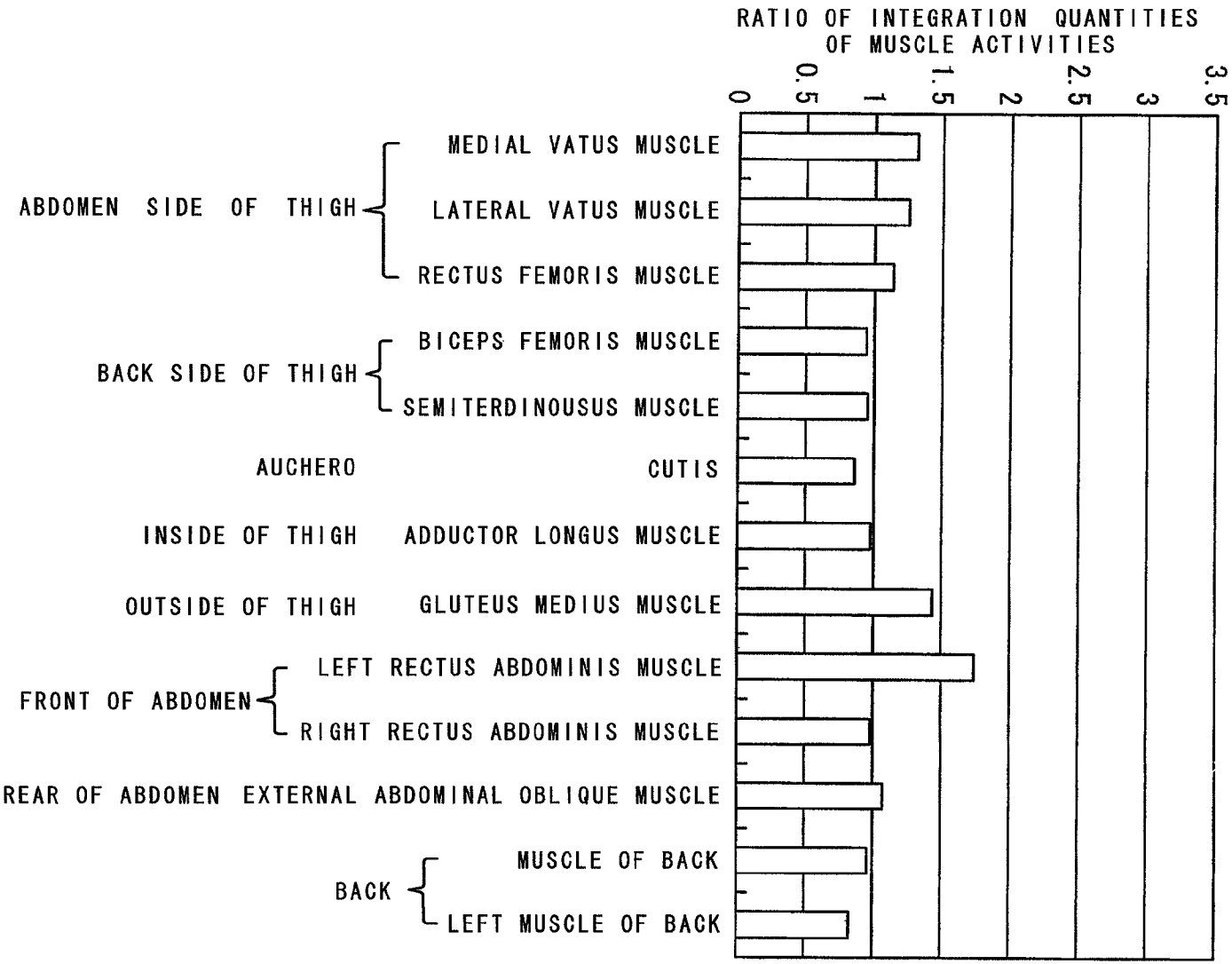
FIG. 13 is a graph showing results of comparisons where integration quantities of the muscle activities at various regions of a human body of a trainee in a reverse mode with those in a normal mode.

FIG. 13 shows results of comparisons where integration quantities of the muscle activities at various regions of a human body of a trainee actually measured when the seat driving apparatus 3' was driven in the reverse mode with those when the seat driving apparatus 3' was driven in the normal mode. In FIG. 13, the ordinate shows ratios of the integration quantities of the muscle activities at various regions in the reverse mode with respect to those in the normal mode, and the abscissa shows the regions of the human body. The value "1" on the ordinate means a condition that the integrated value of the muscle activity of a region of the human body in the reverse mode is equal to that in the normal mode.

When taking notice of a specific muscle, it is possible to increase the effect of muscle strength of the specific muscle by driving the seat driving apparatus 3' so as to increase, for example, the moving speed of the seat 2. On the other hand, when taking notice of a group of specific muscles, it is possible to change the regions of muscles where the muscle strengths are increased by driving the seat driving apparatus 3' so as to vary the locus of the seat 2.

As can be seen from FIG. 13, the quantities of the muscle activities of the thigh for ventrally side, the gluteus medius muscles (abductor muscles of hip joint), and a part of the muscles of abdomen (left rectus abdominis muscles) are increased more than 30% when the periodic swing motion was practices in the reverse mode. These are muscle groups serving as important roles for walking. The example shown in FIG. 13 shows the fact that the periodic swing motion in the reverse mode can innervate these groups of muscles, selectively. Thereby, it is possible to increase the effect of exercise to the predetermined regions of the human body by driving the swing exercise machine in the reverse mode. The memory 47 (see FIG. 8) may memorize one or more swing pattern that enables to vary integration quantities of muscle activities of the trainee.

Figure 14A:
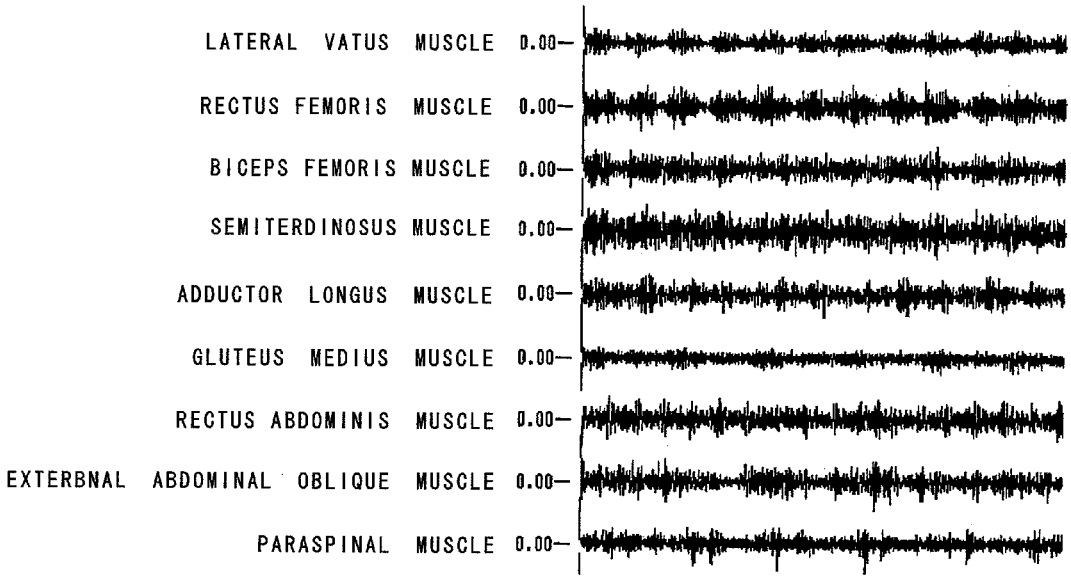
FIG. 14A is an electromyogram showing muscle activities of specific muscles of a human body in the normal mode.
Figure 14B:
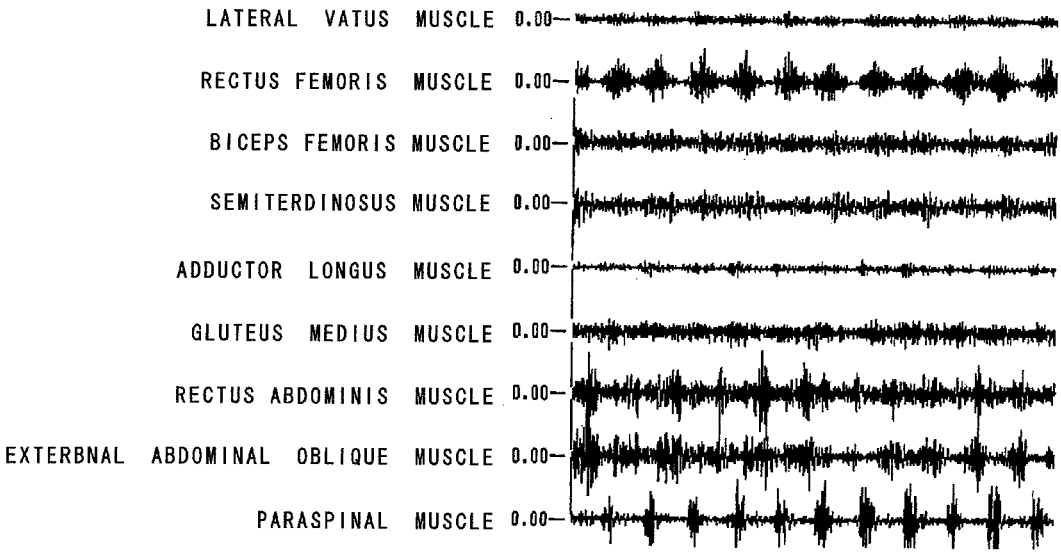
FIG. 14B is an electromyogram showing muscle activities of specific muscles of a human body in the reverse mode.

FIGS. 14A and 14B are electromyograms respectively showing muscle activities of specific muscles of the human body in the normal mode and in the reverse mode, which were actually measured when a trainee sat on the seat 2 while the swing exercise machine 1 was driven.

In the normal mode shown in FIG. 14A, since the muscle discharges of the specific muscles shown in the figure are dispersed substantially evenly along the time axis, it is found that the muscle activities of the specific muscles occurred continuously in the entire phases of the swing motion. In other words, the swing exercise can be performed transitively with subjectively cushy feeling in the normal mode where the seat driving apparatus 3' is driven in the normal mode.

In the reverse mode shown in FIG. 14B, since the muscle discharges of the specific muscles vary strong and weak repeatedly at a predetermined time interval along the time axis, it is found that the muscle activities of the specific muscles occurred intermittently at the predetermined time interval. The variation of strong and weak of the muscle activities corresponds to the phase of the periodic swing motion. This phenomenon shows a fact that the locus of the periodic swing motion of the seat 2 includes phases where the muscle activities easily occur and other phases where the muscle activities do not occur easily. The muscle activities of the specific muscles, such as the external abdominal oblique muscle and the paraspinal muscle in the reverse mode are concentrated in the specific phases. In other words, by driving the seat driving apparatus 3' in the reverse mode, it is possible to concentrate the muscle activities to the specific muscles. Furthermore, it is possible to change the specific muscles to which the muscle activities are concentrated by varying the locus of the seat 2 driven by the seat driving apparatus 3'. When the muscle activities are concentrated to the specific muscle, the muscle discharges of the specific muscles are increased, temporarily. Thereby, the neuromuscular systems of the regions of the specific muscles can be innervated strong, temporarily, even though the total quantity of the innervating is the same as that in the normal mode. Consequently, the excitation of the neuromuscular systems can be accelerated. The memory 47 may memorize one or more swing pattern that enables to vary muscle activities of the trainee in time. By selecting the swing pattern, it is possible to vary the specific phases where the muscle activities of the specific muscles are concentrated.

Figure 15:
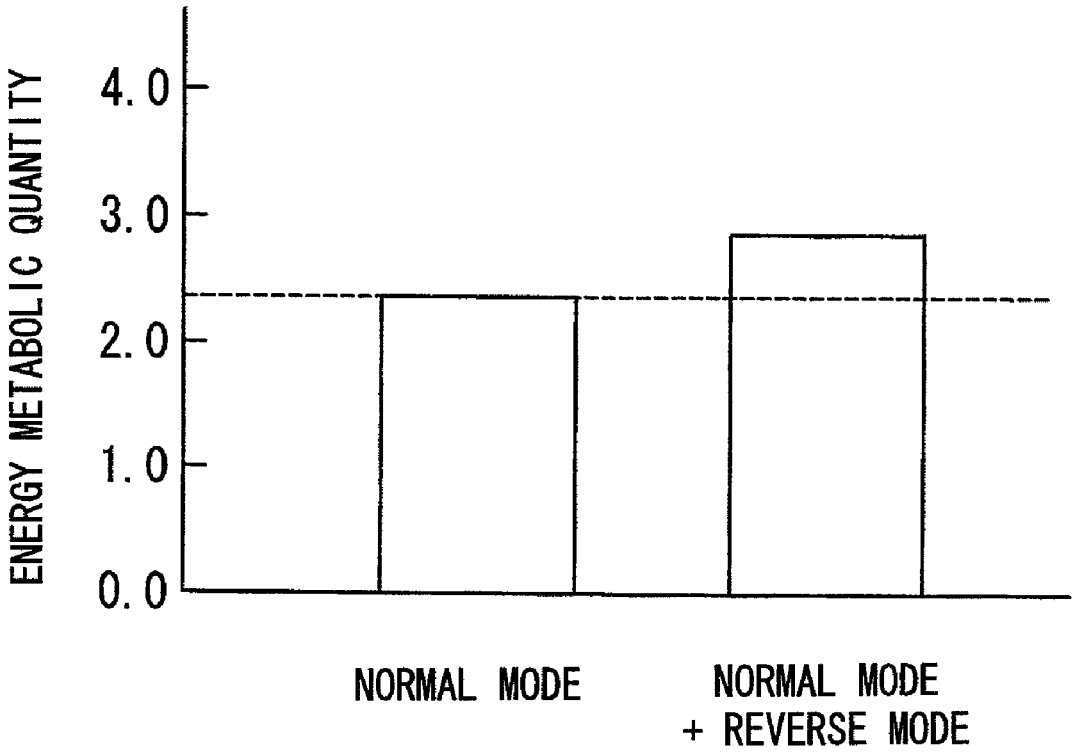
FIG. 15 is a graph showing a comparison of energy metabolic quantity of a trainee when the seat driving apparatus is driven in only the normal mode with that when the seat driving apparatus is driven in both of the normal mode and the reverse mode.

FIG. 15 shows a result of comparison of a metabolic quantity of energy of a trainee who exercised in combination of the normal mode and the reverse mode with that of the trainee who exercised only in the normal mode. As can be seen from FIG. 15, it is found that the metabolic quantity of energy in combination of the normal mode and the reverse mode becomes larger than that only in the normal mode. Accordingly, the effect of aerobic exercise can be increased with using the swing exercise driven in the reverse mode. The memory 47 may memorize one or more swing pattern that enables to vary energy metabolic quantity of muscle activities of the trainee. By varying the combination of the normal mode and the reverse mode, it is possible to vary the metabolic quantity of energy of the trainee.

Other Modifications

The swing exercise machine in accordance with the present invention is not limited to the above mentioned embodiments. A swing exercise machine in accordance with the present invention comprises at least a seat on which a trainee sits, a seat driving apparatus that moves the seat periodically in at least one direction among an anteroposterior direction, a transverse direction and a vertical direction, and swings the seat around at least one axis among an anteroposterior axis, a transverse axis and a vertical axis, and a reversing circuit to reverse a moving direction of a periodic swing motion of the seat driven by the seat driving apparatus. The configuration of the seat driving apparatus is not limited to the above mentioned description or illustration of drawings.

It is preferable that the seat be moved along a locus which is formed by a combination of at least two periodic swing motions, one of which is a periodic swing motion around an anteroposterior swing shaft, and another of which is a periodic swing motion around a transverse swing shaft. The anteroposterior swing shaft and the transverse swing shaft may be driven by a single motor, simultaneously. In this case, the configuration of the seat driving apparatus and the control of the motor can be simplified. Furthermore, the periodic swing motion in the anteroposterior direction and the periodic swing motion in the transverse direction are synchronized, in other words, a predetermined phase relation between these two periodic swing motions are maintained.

Alternatively, the anteroposterior swing shaft and the transverse swing shaft may be driven by two motors which are individually controlled. In this case, although the configuration of the seat driving apparatus and the control of the motors becomes complex, the periodic swing motion in the anteroposterior direction and the periodic swing motion in the transverse direction can be asynchronous. Thereby, the shape of the locus of the periodic swing motion of the seat can be formed optionally by selecting the rotation speeds of two motors. Under such a condition, when the driving direction of the seat driving apparatus is switched, the shape of the locus of the periodic swing motion of the seat differs from that when the seat driving apparatus is driven in the normal mode. In addition, the variation of the moving speed or acceleration of the seat at the turning point in the direction of the swing motion can be varied.

Still furthermore, the rotation speed of each motor may be varied corresponding to a predetermined variation pattern while the periodic swing motion. By such a configuration, it is possible to vary the variation of the moving speed of the seat or the acceleration force that the human body receives from the seat, optionally.

This application is based on Japanese patent application 2006-89641 filed Mar. 28, 2006 in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A swing exercise machine comprising:

a seat;

a pedestal to which the seat is mounted;

a movable table;

a pair of front links and a pair of rear links connected at a front end and a rear end of the movable table and the pedestal, respectively, and configured to support the pedestal in a manner to be swung in a first direction;

a base plate supporting the movable table configured to be swung around an axis in the first direction; and a seat driving apparatus provided between the pedestal and the movable table, the seat driving apparatus comprising:

a single motor connected to the movable table, a first driving unit that converts a driving force of the single motor to reciprocal linear motion in the first direction or reciprocal swing motion around an axis in a second direction perpendicular to the first direction, and a second driving unit that converts the driving force of the single motor to reciprocal swing motion around the axis in the first direction, wherein the single motor is connected to the movable table such that an output shaft of the single motor extends perpendicular to a bottom face of the movable table, the first driving unit comprises:

a motor gear fixed to the output shaft of the single motor;

a first gear engaged with the motor gear;

a first shaft, opposite ends of which are respectively supported on the movable table, and the first shaft is fixed to the first gear so that a driving force of the output shaft is transmitted to the first shaft;

an eccentric crank coupled to an end of the first shaft; and an arm link, one end of which is coupled to the eccentric crank and another end of which is pivoted to one of the pair of front links by a pin, wherein when the first shaft is rotated, the eccentric crank circulates eccentrically with respect to the first shaft such that the pair of front links move reciprocally via the arm link in the first direction, and the second driving unit comprises:

a first shaft gear which is fixed on the first shaft;

a second gear which is engaged with the first shaft gear;

a second shaft, opposite ends of which are operably connected to the movable table, and the second gear is fixed to the second shaft; and an eccentric rod, disposed on a side of the pedestal parallel to the first direction, and one end of which is coupled eccentrically to the second shaft and another end of which is rotatably pivoted on the base plate, wherein an upper end of the eccentric rod is coupled eccentrically to an end of the second shaft by a pin, and a lower end of the eccentric rod is rotatably pivoted on a coupling member, which has an L-shape and fixed on the base plate with a pin, so that when the second shaft is rotated the upper end of the eccentric rod circulates eccentrically and the seat mounted on the pedestal is reciprocally rotated around a swing shaft of the movable table with respect to the base plate.

2. The swing exercise machine in accordance with claim 1, further comprising:

a reversing circuit configured to reverse a rotation direction of the output shaft of the single motor; and a timing setter that determines timing to reverse the rotation direction of the output shaft of the single motor.

3. The swing exercise machine in accordance with claim 2, wherein a rotation speed of the output shaft of the single motor and the timing to reverse the rotation direction of the output shaft of the single motor are variable.

* * * * *